US005394926A

United States Patent [19]

Kraeutler

[11] Patent Number: 5,394,926

[45] Date of Patent: Mar. 7, 1995

[54] ANTI-BACTERIA RAISABLE GOODS-HANDLING DOOR

[75] Inventor: Bernard Kraeutler, Dunieres, France

[73] Assignee: Nergeco, Dunieres, France

[21] Appl. No.: 999,122

[22] Filed: Dec. 31, 1992

[30] Foreign Application Priority Data

Jan. 15, 1992 [FR] France ..... 92 00362

[51] Int. Cl.[6] ..... A47H 1/00

[52] U.S. Cl. ..... 160/264; 160/267.1; 160/84.01; 160/84.08

[58] Field of Search ..... 160/84.1, 264, 269, 160/271, 272, 273.1, 274, 270, 267.1, 268.1, 277, 260, 201, 96 R, 87.2

[56] References Cited

U.S. PATENT DOCUMENTS

| | | | |
|---|---|---|---|
| 2,491,765 | 12/1949 | Rambo | 160/267.1 |
| 3,430,677 | 3/1969 | Pierce | 160/264 |
| 3,500,481 | 3/1970 | McKwane | 160/84.1 X |
| 3,777,425 | 12/1973 | LeBourgeois | 160/84.1 X |
| 4,725,000 | 2/1988 | Deziel | 160/84.1 X |
| 4,776,379 | 10/1988 | Kraeutler | 160/271 X |
| 4,800,946 | 1/1989 | Rosenoy | 160/264 |

FOREIGN PATENT DOCUMENTS 9015913 12/1990 WIPO .

*Primary Examiner*—Blair M. Johnson
*Attorney, Agent, or Firm*—Sughrue, Mion, Zinn, Macpeak & Seas

[57] ABSTRACT

A raisable goods-handling door of the type includes a flexible curtain capable of being wound up or of being folded up in the top portion of the door, said curtain being reinforced by at least one reinforcing or loading bar, the door being wherein the bar is made up of two half-bars that are disposed at the same level on the two faces of the curtain and, clamping provided so that the two edges of each half-bar are pressed against the curtain in sealed manner, thereby preventing dust or dirt from penetrating between either half-bar and the corresponding face of the curtain.

5 Claims, 4 Drawing Sheets

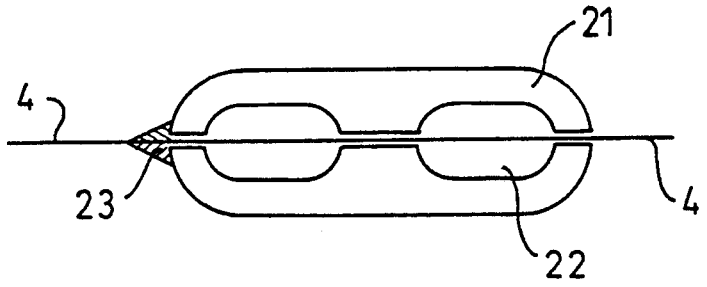
FIG.8
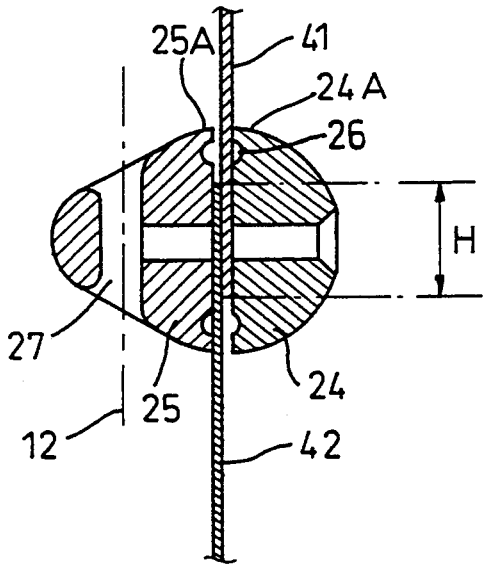
FIG.9
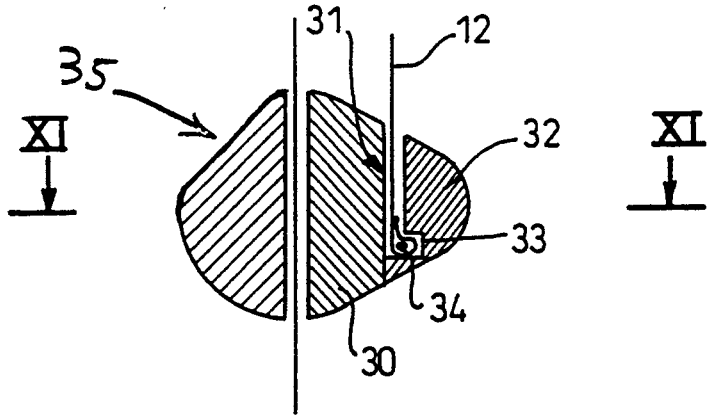
FIG.10
FIG.11
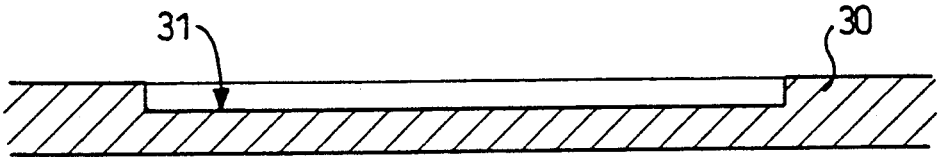

ANTI-BACTERIA RAISABLE GOODS-HANDLING DOOR

The present invention relates to raisable, "goods-handling" doors, i.e. doors for industrial buildings, hangars, or shops, which are generally large so as to allow trucks (both road vehicles and fork-lift trucks) to pass through, the doors being capable of opening and closing quickly.

BACKGROUND OF THE INVENTION

Such doors comprise a curtain that is capable of being raised and lowered quickly. One kind of door comprises a flexible curtain capable of being wound up or folded concertina-like at the top of the door. When such doors are of a certain width, or when they are required to withstand wind pressure, they are reinforced by reinforcing bars disposed at regular vertical intervals up the door. The ends of the bars can slide in slideways formed by or contained in lateral uprights framing the door-bay that is opened and closed by the door.

The invention relates more particularly to a door of the latter kind, and it relates to a door that is more particularly adapted for use in workshops or warehouses for foods or pharmaceuticals. In this kind of installation, attempts are made to eliminate dirt traps, i.e. spaces or volumes that are inaccessible to cleaning and in which all kinds of dust or waste can accumulate and stagnate and thus allow bacteria to develop. In particular, doors together with their drive systems and their need to be operable constitute privileged zones for dirt traps and for volumes that are inaccessible to cleaning.

An object of the invention is to provide a door that is capable of being washed completely, and in which bacteria traps are reduced or eliminated.

SUMMARY OF THE INVENTION

According to the present invention, this object is achieved by a raisable goods-handling door of the type comprising a flexible curtain capable of being wound up or of being folded up in the top portion of the door, said curtain being reinforced by at least one reinforcing or loading bar, wherein the bar is made up of two half-bars that are disposed at the same level on the two faces of the curtain, clamping means being provided so that the two edges of each half-bar are pressed against the curtain in sealed manner, thereby preventing dust or dirt penetrating between either half-bar and the wall of the curtain.

Advantageously, the surfaces of the half-bars making contact with the curtain do not have any cavities, each half-bar being pressed against the curtain via a continuous surface that is preferably planar.

It may also be advantageous for a sealant to be placed between the half-bar and the adjacent surface of the curtain, at least in the vicinity of the edges of the half-bar.

Quite frequently, the ends of the reinforcing bars move in guiding slideways placed on the two sides of the door-bay that is opened and closed by the curtain. These slideways may form lateral uprights for the door or they may be housed in such uprights.

French patent 91 13435 describes a raisable-curtain door for closing a door-bay, including two lateral uprights each having one slideway, the curtain including lateral portions that slide in said slideways, each lateral upright including a front wall provided with a slot that forms the slideway of said upright, said front wall being at least locally non-parallel to the curtain in the vicinity of the slot, said front wall being provided with a first surface substantially facing said door-bay and with a second surface substantially facing away from the door-bay, characterized in that said second surface is accessible to enable it to be cleaned.

In particular, each of the lateral uprights is a substantially channel-section member, including an opening that does not face the door-bay to be closed.

Such doors enable the insides of the slideways to be cleaned, thereby avoiding dirt retention and the development of bacteria. That is why it is particularly advantageous to combine the present invention with the disposition described in that patent.

The invention thus also provides a door of the type defined above in which the ends of the bars move in guiding slideways that are open at their faces facing away from the door.

BRIEF DESCRIPTION OF THE DRAWINGS

Embodiments of the invention are described by way of example with reference to the accompanying drawings, in which:

FIGS. 8, 9, and 10 are section views of other curtain-reinforcing bars of the invention, on planes perpendicular to the bars;

FIG. 11 is a fragmentary section view of an element of FIG. 10 on a horizontal plane XI—XI of FIG. 10, FIG. 12 shows an embodiment wherein one of the half-bars comprises a plurality of plates.

In the various drawings, the same references are used to designate items that are the same or that are similar.

DETAILED DESCRIPTION

Figure 1:
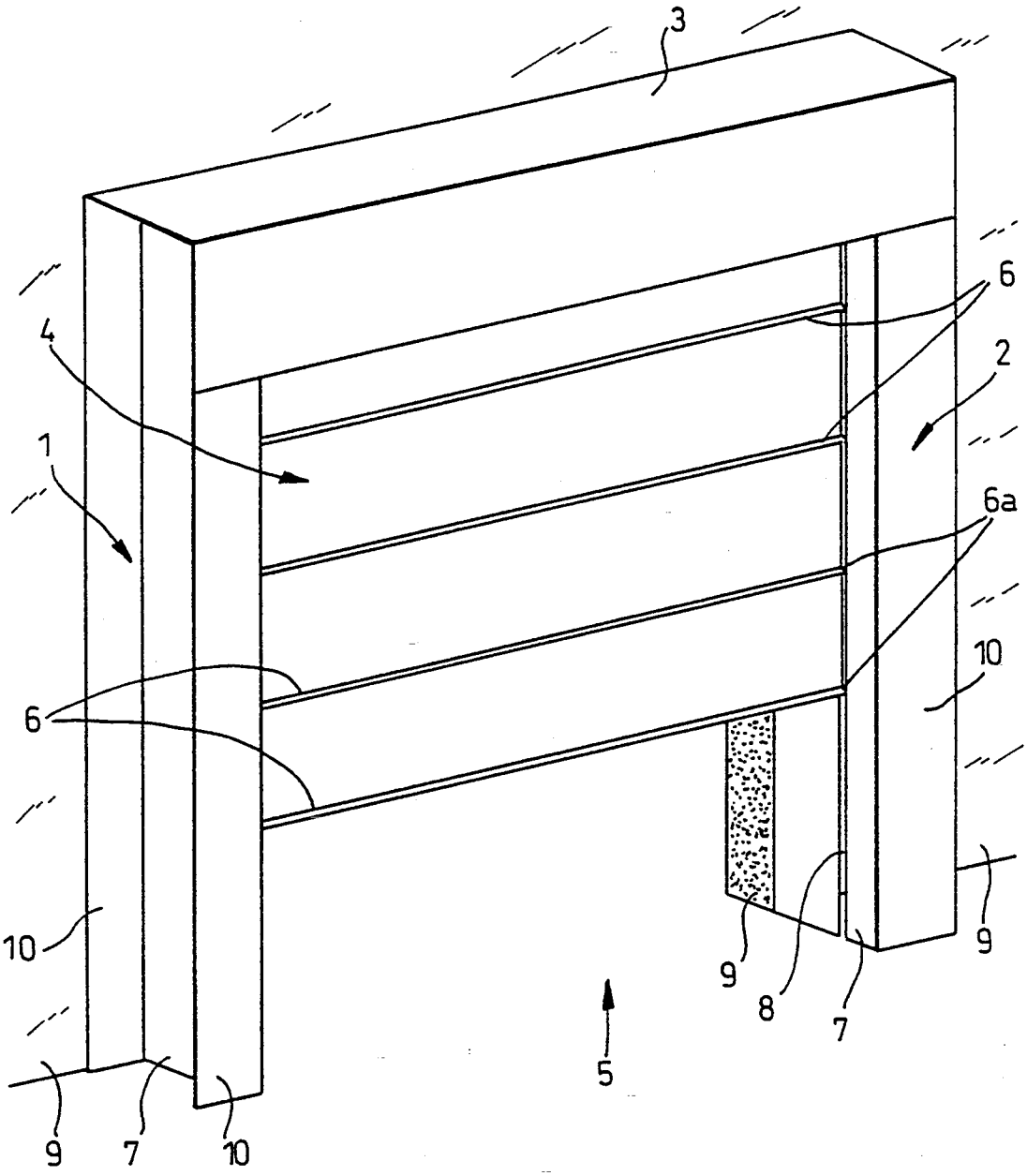
FIG. 1 is a perspective view of a raisable-curtain goods-handling door to which the present invention may be applied.

As shown in FIG. 1, the present invention relates to a door for closing a door-bay 5 in a wall 9, in particular in premises where very strict hygiene must be maintained. The door comprises a raisable curtain 4 and two lateral uprights 1 and 2 each formed with a curtain-guiding slideway 8. In the example shown in FIG. 1, the lateral uprights 1 and 2 are interconnected at their top ends by a cross-bar 3, but this characteristic could be omitted without going beyond the ambit of the present invention. The door shown in FIG. 1 is of the type commonly called a "goods-handling door", i.e. it is a rapidly-opening door for allowing a goods-handling vehicle to pass, and for closing after said vehicle has gone through the door.

In this case, each lateral upright 1, 2 includes a front wall 7 which is substantially perpendicular to the curtain 4 and which is formed with a longitudinal slot 8 that constitutes said slideway. It will be observed that the wall 7 need not necessarily be perpendicular to the curtain 4: it suffices for the wall 7 to be locally non-parallel to the curtain 4 in the vicinity of the slot 8. In the example shown in FIG. 1, the lateral uprights 1 and 2 are channel-section members, each having two flanges 10 that extend a certain distance away from said wall 7 away from the door-bay 5. Such a channel-section is not limiting in any way.

The curtain 4 includes lateral portions that slide in the slots 8 of the uprights 1 and 2. In the particular example of FIG. 1, the curtain 4 is flexible and includes horizontal reinforcing bars 6 having axial ends 6*a* that slide in the slots 8. In a variant, the curtain 4 could include lateral edges that are continuous or discontinuous and that slide in the slots 8: under such circumstances, the curtain 4 need have only one bottom bar to weight it down.

Figure 2:
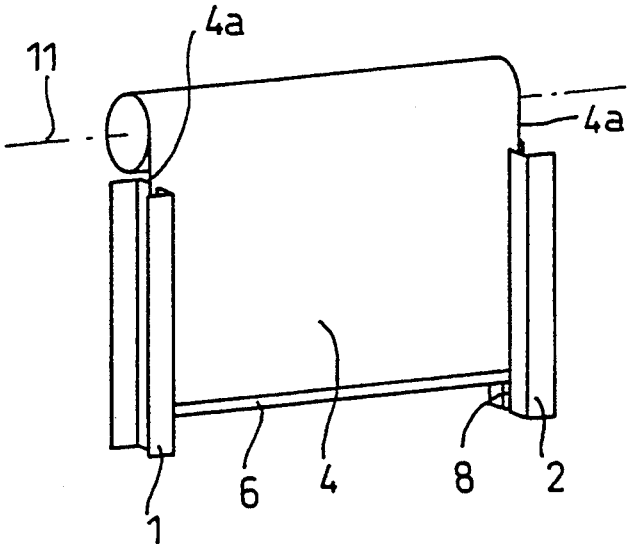
FIG. 2 shows one example of a system for operating the door of FIG. 1.
Figure 3:
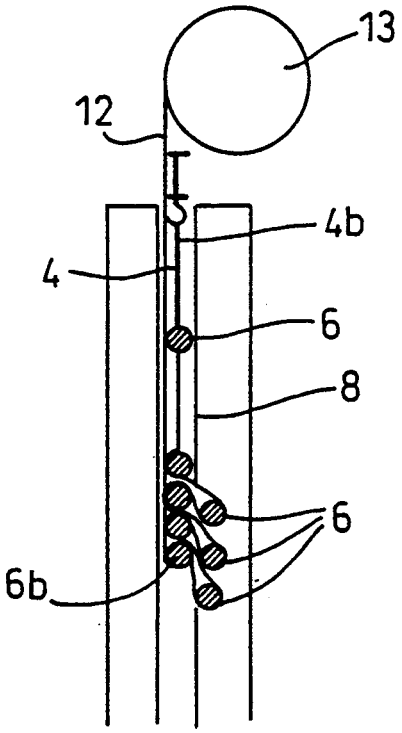
FIG. 3 shows another example of a system for operating the door of FIG. 1.

The door of the invention may be actuated by mechanical or electrical means that are well known in the state of the art. The curtain may be raisable in various different ways. For example, in FIG. 2, the curtain 4 can be wound onto a horizontal shaft 11 at the top of the door. In another example shown diagrammatically in section in FIG. 3, the curtain 4 is constituted by a flexible wall fitted with horizontal reinforcing bars 6, every other one of which slides in the slots 8 of the uprights 1 and 2. The bottommost bar is connected to straps 12 which wind onto a drum 13 at the top of the door. When the straps 12 are wound onto the drum 13, the bottom bar is raised, and it entrains the other reinforcing bars 6 whose ends slide in the slideways 8, with the curtain 4 folding up concertina-like. To make this possible, the straps pass through loops fixed to some of the bars or, where appropriate through all of the bars.

Figure 4:
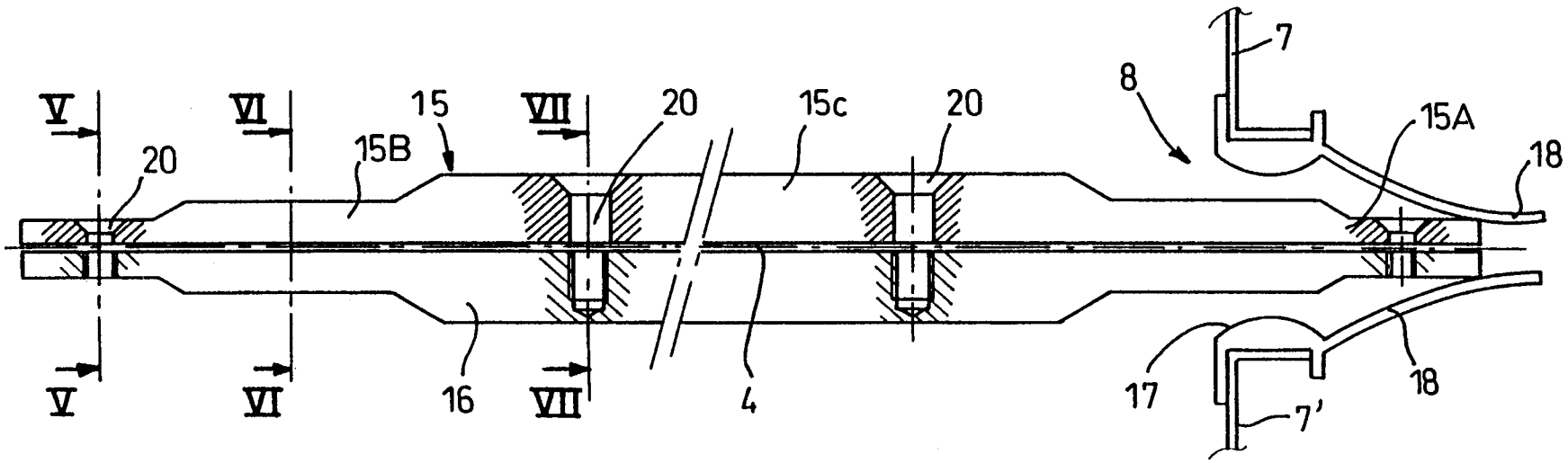
FIG. 4 is a section view on a horizontal plane through a reinforcing bar for a curtain of a goods-handling door of the invention.

FIG. 4 is a section view in a horizontal plane through an example of a reinforcing bar of the invention for the curtain of FIG. 1. Part of the long middle portion of the bar is omitted so as to reduce the size of the drawing. The bar is made up of two halves 15 and 16 that are identical apart from their fixing points. The two halves may be made of plastic, metal, or any other material that is sufficiently rigid, while nevertheless having a degree of flexibility. These halves may be fastened together, clamping the curtain between them, by means of flat-head screws 20 (the curtain being made of fabric or of plastic).

The ends of the bar may taper so as to enhance sealing between the edges of the slideway. On the right-hand side of the figure, there can be seen the front wall 7 of the righthand upright. This wall is made up of two portions 7, 7′ which define the slot 8 between them.

Figure 6:
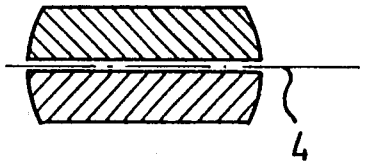
FIGS. 5, 6, and 7 are section views on planes V—V, VI—VI, and VII—VII of FIG. 4.
Figure 7:
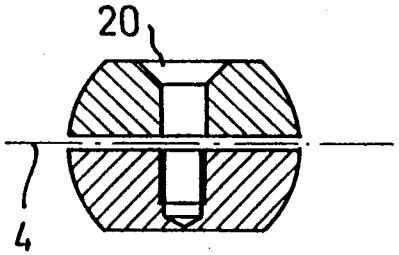
Figure 5:
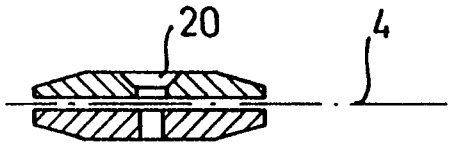

On the walls 7 and 7′, the edges of the slot may be provided with a flexible lining 17 for sealing and sliding purposes, the lining comprising a rounded portion 17 mounted on the edge of the wall 7 and a plastic lip 18 integral with the rounded portion, and disposed in such a manner that the two lips 18 are urged against each other. The portion 15A of the bar disposed between the lips 18 can be very narrow, and may be connected to the main portion 15C via an intermediate portion 15B. FIGS. 5, 6, and 7 are sections on respective planes V—V, VI—VI, and VII—VII.

The section of FIG. 6 is made through the connecting portion 15B at a location where the bar is solid. The sections of FIGS. 5 and 7 coincide with fastening screws. The curtain 4 is clamped between the two halves of the bar. The use of flat-head screws ensures that the countersunk hole is sealed by the clamping pressure against the conical portion of the screw head.

In order to save matter and to lighten the door, it is possible to use hollow bars 21 as shown in section in FIG. 8. However, the cavities 22 formed in this way could become volumes in which bacteria develop should the peripheral sealing become faulty. It may be appropriate to fill the cavity with a filler and to cover the joints at the edges of the bars with a sealant 23 such as silicone applied against the edges of the bar and against the curtain. Advantageously, when a bar element is hollow, the outside of the element is made of a color that is different from the bulk of the element so that breaks are easily seen, thereby enabling a faulty bar element to be replaced.

The bars may be used to hold together two strips from which the curtain is made. For example a transparent strip and an opaque strip. From the sealing point of view, such a junction must be made carefully so as to avoid becoming a nest for bacteria. An example of such a junction is shown in section in FIG. 9. Two strips of curtain 41 and 42 overlap over a certain height H, and said height H is clamped between two half-bars 24 and 25. The edges of each strip do not project along the other side. It is therefore not possible to clamp the curtain tightly enough along the edges 24A and 25A where the bars meet since there are two thicknesses of curtain in the middle of the bars but only one thickness of curtain at the edges. The voids are therefore filled with a sealant, e.g. of the silicone type, and to ensure that it stays securely in place, a groove 26 is provided on the inside section of each bar along beth edges thereof, the groove providing good fastening between the bar and the sealant. The strips of curtain are thus connected together in a manner that is both clean and neat in appearance.

To make a sliding connection between a bar and a curtain-raising strap 12, it is advantageous in the context of the present invention for a passage 27 through the thickness of the bar to be formed with rounded edges to facilitate proper cleaning.

The connection between a curtain-raising strap and the bottom bar, which may optionally constitute a weight, may be formed in the manner shown in FIG. 10. One of the half-bars is split in two along the width of the strap and therefore has a section of the kind shown in FIG. 11 over the width of the strap.

The half-bar 30 includes a hollowed-out flat zone 31 extending over a length that is equal to or slightly greater than the width of a curtain-raising strap 12. The strap is wedged between said flat zone 31 and a plug 32 having a groove 33 formed therein to receive the folded end of the strap, and optionally including a pin 34 placed in the fold in the strap. The plug 32 may be screwed to the half-bar 30 through the strap, or beyond the strap on either side thereof. The fixing may be provided with a sealant.

Such a flat zone may also be provided, for example, for fixing a sliding shoe of the kind suitable for use with a different type of slideway.

It may be observed that one of the half-bars may be made up of a plurality of elements, e.g. plates 50, each being pressed through the curtain 4 against a single bar 51 disposed on the other side of the curtain, as shown in FIG. 12.

In an advantageous embodiment, as shown in FIG. 10, the bar may have a sloping top surface 35 that forms a roof for facilitating the run-off of water (washing water or condensation) and to avoid water stagnating on the top of the half-bar.

I claim:

1. A raisable goods-handling door of the type comprising a flexible curtain capable of being retracted and stored in a top portion of the door, said curtain being reinforced by at least one reinforcing bar, wherein the bar is made up of two half-bars that are disposed at the same level on two opposite faces of the curtain, clamping means being provided so that opposing faces of each half-bar are pressed against the curtain in a sealed manner, thereby preventing dust or dirt from penetrating between either half-bar and the respective face of the curtain, wherein ends of the bars move in guiding slideways, and wherein the guiding slideways are open on respective faces opposite the door.

2. A raisable good-handling door of the type comprising a flexible curtain capable of being retracted and stored in a top portion of the door, said curtain being reinforced by at least one loading bar, wherein the bar is made of two half-bars that are disposed at the same level on two opposite faces of the curtain, clamping means being provided so that opposing faces of each half-bar are pressed against the curtain in a sealed manner, thereby preventing dust or dirt from penetrating between either half-bar and the respective face of the curtain, wherein one of the half-bars comprises a plurality of elements, each of said elements being pressed through the curtain against the other of said half-bars disposed on the other side of the curtain, in which the ends of the bars move in guiding slideways, the guiding slideways are open on respective faces opposite to the door.

3. A raisable good-handling door of the type comprising a flexible curtain capable of being retracted and stored in a top portion of the door, said curtain being reinforced by at least one reinforcing bar, wherein the bar is made of two half-bars that are disposed at the same level on two opposite faces of the curtain, clamping means being provided so that two adjacent faces of each half-bar are pressed against respective faces the curtain in a sealed manner, thereby preventing dust or dirt from penetrating between either half-bar and the corresponding face of the curtain, wherein grooves are provided on opposing peripheral portions of each respective face of a half-bar pressed against the curtain for receiving and retaining a sealant.

4. A door according to claims 1, 2, or 3, in which a hollow zone is provided on at least one bar for receiving a fastening for a strap.

5. A door according to claims 1, 2 or 3, in which the bars have respective top portions in the form of a roof for enhancing water run-off.

* * * * *